United States Patent [19]

Kery

[11] 3,957,099

[45] May 18, 1976

[54] ART OF MANUFACTURING NEEDLEPOINTED ACCESSORIES

[76] Inventor: Ervin Kery, 509 Mulberry Drive, West Bend, Wis. 53095

[22] Filed: May 22, 1975

[21] Appl. No.: 580,124

[52] U.S. Cl. ..... 150/28 R; 150/52 R; 206/5; 206/349; 206/457

[51] Int. Cl.[2] ..... A45C 3/08

[58] Field of Search ..... 150/28 R, 28 A, 30, 150/46, 52 R; 206/5, 6, 349; D87/3 D, 3 F, 3 H

[56] References Cited

UNITED STATES PATENTS

| | | | |
|---|---|---|---|
| 2,518,572 | 8/1950 | Sanders | 150/28 R |
| 3,575,226 | 4/1971 | Chapman | 150/28 A |

FOREIGN PATENTS OR APPLICATIONS

| | | | |
|---|---|---|---|
| 534,674 | 1/1955 | Belgium | 150/28 R |

*Primary Examiner*—Donald F. Norton
*Attorney, Agent, or Firm*—Arthur L. Morsell, Jr.

[57] ABSTRACT

A cover flap is permanently, hingedly attached along one edge to the inner portion of an accessory side panel, the latter carrying a needlepoint foundation canvas. The flap is dimensioned to cover the inner surface of the canvas and there is means for removably securing the free portion of the flap in canvas-covering position. In one embodiment, the side panel is laminated, and the cover flap is formed by a portion of the inner side panel lamination, which portion is outlined by a U-cut.

8 Claims, 11 Drawing Figures

Fig. 1
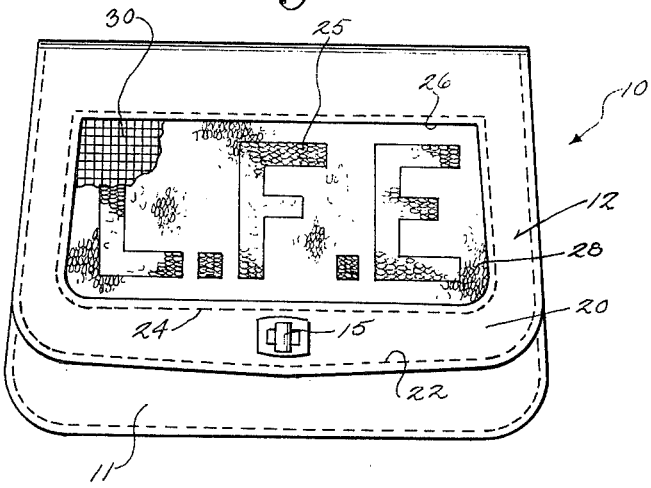
Fig. 4
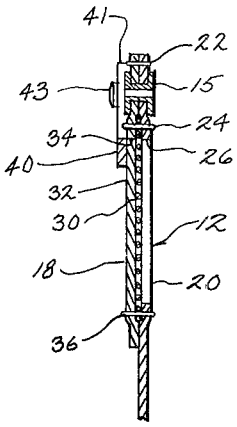
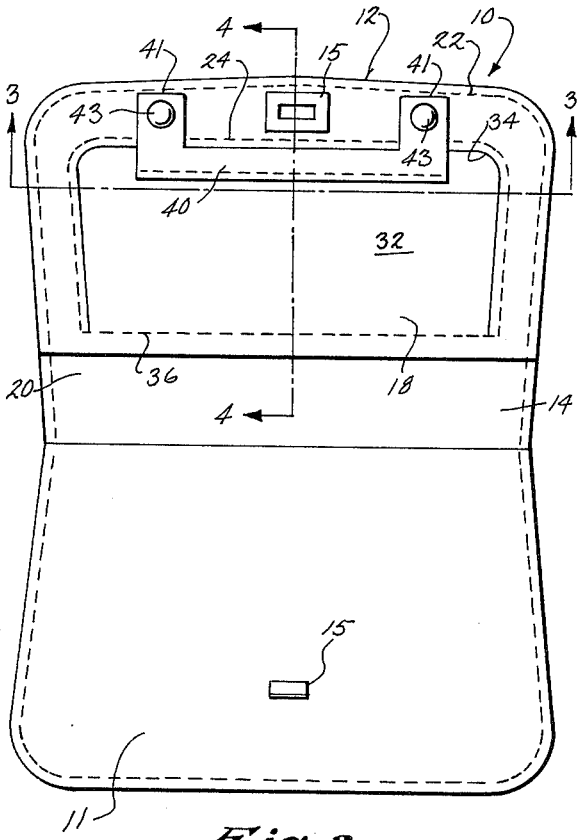
Fig. 2
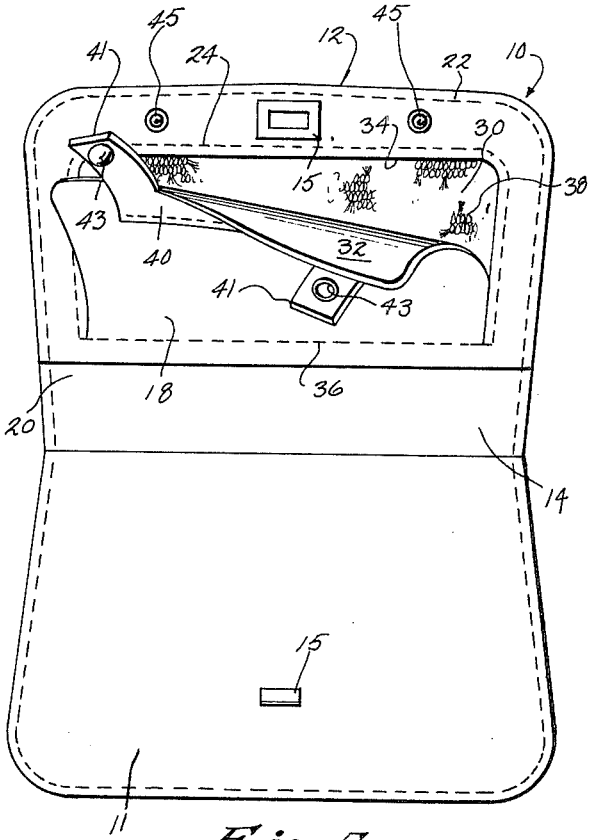
Fig. 5
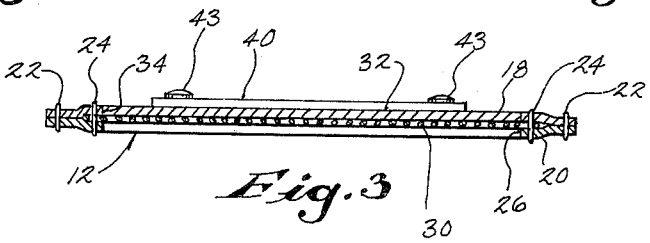
Fig. 3

Fig.6
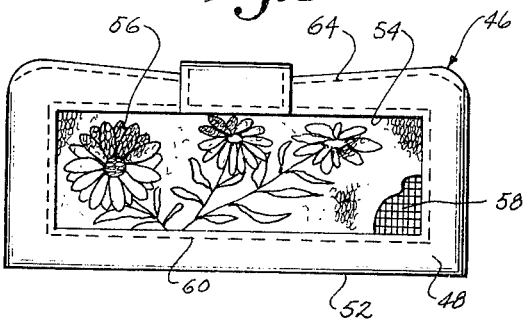
Fig.7
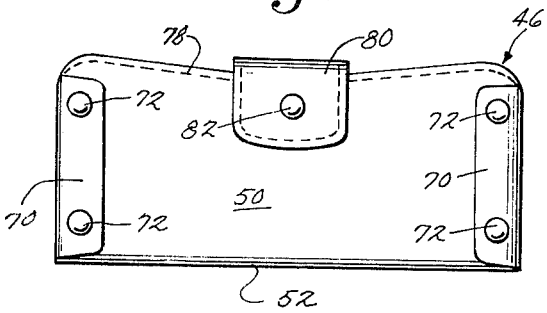
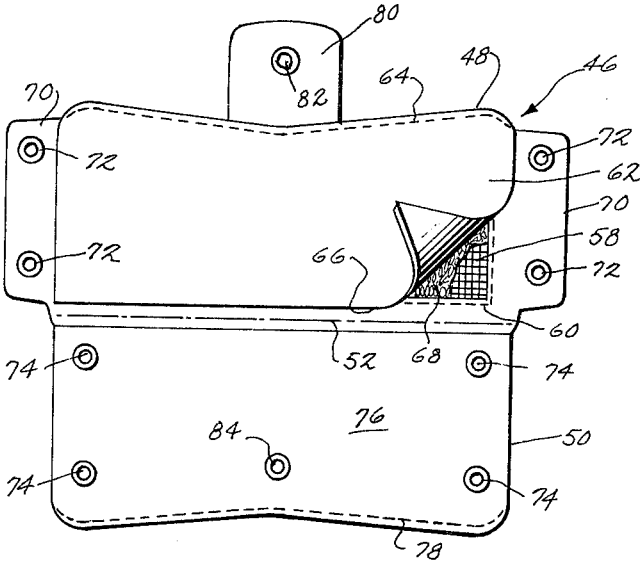
Fig.8
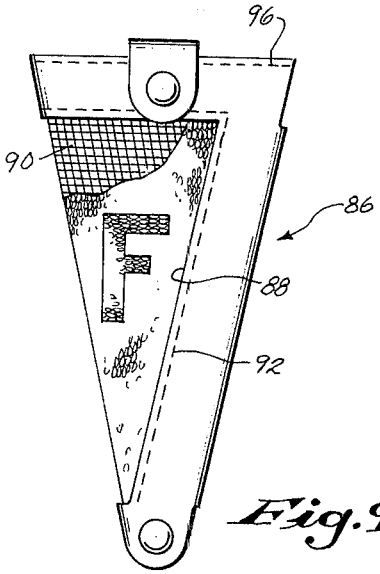
Fig.9
Fig.11
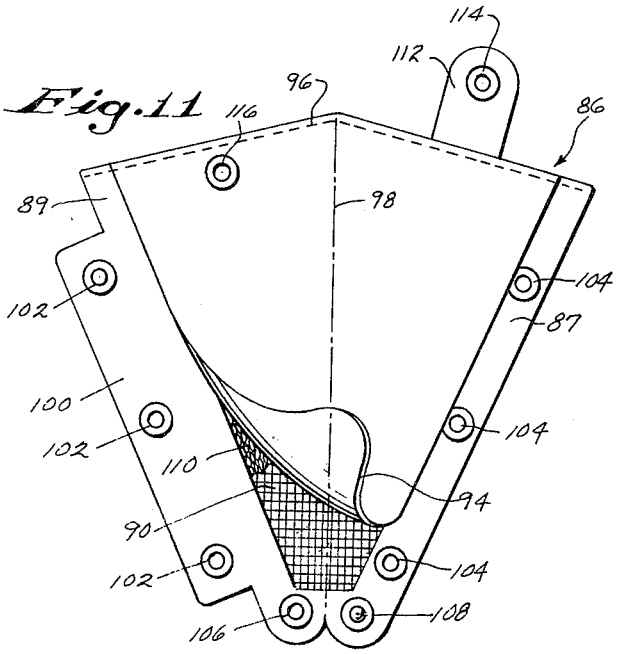
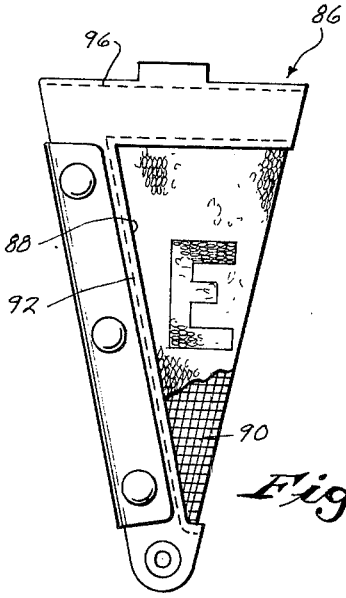
Fig.10

ART OF MANUFACTURING NEEDLEPOINTED ACCESSORIES

BACKGROUND OF THE INVENTION

This invention relates to needlepoint panels on women's accessories such as handbags, shoulder bags, eyeglass cases, scissor cases, and the like.

In the past, needlepoint foundation canvas has been provided in the form of one or more side panels for use in women's accessories to permit the woman to work a needlepoint pattern of her own choosing in the panel. Such needlepoint patterns have an outer decorative side which is exposed to view on the exterior of the panel and an inner "wrong" side which is unsightly and which includes projecting yarn ends. However, since the inner surface of the needlepoint foundation canvas must be manually accessible to permit the working of the needlepoint pattern thereon, it cannot be covered until after the needlepoint pattern has been completed, and in the past this has posed a problem in the manufacture of accessories having needlepoint panels. In some cases, the needlepoint pattern was first completed on a separate piece of needlepoint foundation canvas and was then sent to an accessory manufacturer, who incorporated it into a selected accessory, which was then sent to the customer. But this method was expensive and time-consuming both for the manufacturer and for the customer. In other cases, a separate inner needlepoint cover sheet has been provided to be glued over the inner rough surface of the needlepoint pattern after it was completed. However, the glued cover sheet was undesirable because it did not provide a good match or finished effect, and the cover material tended to pucker along the glued edge and also tended to come loose in use. In addition, in some cases the right type of glue was not available in the customer's home, which meant that extra time and effort had to be expended to secure the glue.

SUMMARY OF THE INVENTION

In accordance with this invention, the above-noted problem is solved by providing an accessory with a built-in cover flap which is hingedly attached along one edge to the inner portion of the panel carrying the needlepoint foundation canvas, and which is dimensioned and positioned to neatly cover the inner surface of the canvas while providing an attractive inner surface for the panel. The free edge of the cover flap is readily connectible to the panel by releasable fasteners and can be easily swung away from the canvas to permit manual access for needlepointing and can be quickly and easily fastened over the inner surface of the canvas when the needlepointing has been completed.

DESCRIPTION OF THE DRAWINGS

FIG. 1 is a front view of a clutch bag incorporating one embodiment of the invention, the bag being closed and the outer decorative surface of the needlepoint pattern being exposed to view.

FIG. 2 is a plan view of the clutch bag of FIG. 1 in its open condition showing the flap which neatly covers the rough inner surface of the needlepoint pattern, the flap being in covering condition.

FIG. 3 is a cross-sectional view taken on the line 3—3 of FIG. 2.

FIG. 4 is a longitudinal sectional view taken on the line 4—4 of FIG. 2.

FIG. 5 is a plan view similar to FIG. 2 showing the flap in a partially peeled-back condition exposing the rough inner surface of the needlepoint canvas.

FIG. 6 is a view showing one side of an eyeglass case incorporating a second embodiment of the invention, the eyeglass case being closed and the outer decorative surface of the needlepoint pattern being exposed.

FIG. 7 is a view showing the reverse side of the eyeglass case shown in FIG. 6.

FIG. 8 is an opened-up, plan view of the eyeglass case of FIG. 7 with the flap partially peeled back to expose a portion of the rough inner surface of the needlepoint canvas.

FIG. 9 is a view showing one side of a scissors case incorporating a third embodiment of the invention, the scissors case being closed and a portion of the outer decorative surface of the needlepoint pattern being exposed.

FIG. 10 is a view showing the reverse side of the scissors case of FIG. 9.

FIG. 11 is an opened-up plan view showing the interior of the scissors case shown in FIGS. 9 and 10 with the flap partially peeled back to expose a portion of the rough inner surface of the needlepoint canvas.

DESCRIPTION OF THE PREFERRED EMBODIMENTS

FIGS. 1–4 show a clutch bag 10 incorporating one embodiment of the invention. The bag includes a receptacle portion 11 and a foldable front panel 12 which is an integral extension of the outer side of the receptacle portion, there being a transverse web 14 on which the transverse fold takes place in closing the bag. Front panel 12 may be releasably fastened in closing position by a conventional fastener 15.

In this illustrated example, receptacle portion 11 and front panel 12 are both made of leather, but other suitable flexible materials or fabrics may be employed if desired.

Front panel 12 is of laminated construction and includes an inner lamina or ply 18 and an outer lamina or ply 20 which are sewn together along an outer line of stitching 22 and an inner line of stitching 24. A U-shaped opening 26 (FIG. 1) is cut in outer ply 20 to expose the decorative outer surface 28 of a needlepoint pattern which is worked in an apertured needlepoint foundation canvas 30 (FIGS. 1, 3 and 4) positioned between opening-framing portions of the plies 18 and 20 and secured therebetween by inner line of stitching 24. The yarn 25 which makes up the needlepoint pattern is omitted in FIGS. 3 and 4 in order to more clearly illustrate the foundation canvas 30.

A flap 32 (FIGS. 2 and 5) is formed in inner ply 18 by a U-shaped cut 34 which frames three sides of the inner surface of needlepoint foundation canvas 30. Flap 32 is swingably attached to inner ply 18 along a line of hinge 36 by virtue of the flexibility of inner ply 18. When flap 32 is opened, as shown in FIG. 5, it exposes the inner surface of needlepoint foundation canvas 30 so that it is manually accessible to work the desired needlepoint pattern into foundation canvas 30. When flap 32 is closed, as shown in FIG. 2, it covers the inner surface of foundation canvas 30 and the "wrong" side 38 of the needlepoint pattern worked thereon.

A flexible tab 40 (FIGS. 2 and 5) having projecting ends 41 with snaps 43 thereon is sewn to the edge of flap 32 in position to interact with snaps 45 (FIG. 5) on the edge of panel 12. Snaps 43 and 45 constitute a releasable fastener for holding flap 32 in its closed position. Snaps 43 and 45 can be easily opened to gain access to the rear surface of foundation canvaS 30 to work the desired neeldepoint design therein, and can be just as easily snapped closed to cover the rough inner surface of the needlepoint design. When closed, as in FIG. 2, the flap blends with the material of the inner ply 22 as it is formed therefrom.

FIGS. 6–8 show an eyeglass case 46 containing a second embodiment of the invention. Case 46 has front panel 48 (FIG. 6) and a rear panel 50 (FIG. 7) which are connected together by being made of a single piece of flexible material which can be folded in its central portion along line 52 (FIG. 8). A rectangular opening 54 (FIG. 1) is cut in front panel 48 so that the surrounding panel portions frame the outer decorative surface 56 of a needlepoint pattern worked on an apertured needlepoint foundation canvas 58, which is attached to the rear of front panel 48 by a line of stitching 60.

On the rear of front panel 48 a flexible cover flap 62 (FIG. 8) is permanently, hingedly attached thereto along one edge by a line of stitching 64. Cover flap 62 can be easily peeled back at its free edge 66 to provide manual access to the rear surface of needlepoint foundation canvas 58 to enable the working of a needlepoint pattern thereon. After the needlepoint pattern has been completed, flap 62 is lowered to cover the rough inner surface 68 of the needlepoint pattern.

Two opposed side tabs 70 project from the sides of front panel 48 and carry snaps 72 which are positioned to interact with snaps 74 on back panel 50. Snaps 72 and 74 constitute a releasable fastener for holding front panel 48 and rear panel 50 together in face-to-face relationship to form a receptacle and also to hold flap 62 down over the "wrong" side 68 of the needlepoint pattern to hide it from view. The inner surface of rear panel 50 is preferably lined with a cover sheet 76 which can be made of the same material as flap 62 to blend therewith. Cover sheet 76 is secured along one edge to rear panel 50 by a line of stitching 78, and is also secured by the snaps 74.

A flexible tab 80 carrying a snap 82 is attached to the central top edge portion of front panel 48 by line of stitching 60. Snap 82 is positioned to interact with a snap 84 (FIG. 8) on the central top edge portion of rear panel 50.

To insert the glasses in the case, snap 82 is opened and tab 80 is lifted to open the aperture between front panel 48 and rear panel 50.

Snaps 72 and 74 are opened initially to gain manual access to the inner surface of needlepoint foundation canvas 58 to work a needlepoint pattern therein. After the needlepoint pattern has been completed, tabs 70 are folded around the side edges of rear panel 50 as shown in FIG. 7 and snaps 72 and 74 are closed to hold front panel 48 and rear panel 50 in back-to-back relationship to form a receptacle for the glasses and to hold flap 62 down over the rough inner surface 68 of the needlepoint pattern. Snaps 72 and 74 are normally left in their closed condition after the needlepoint pattern has been completed.

FIGS. 9–11 show a scissors case 86 embodying a third form of the invention. Scissors case 86 is made of a single piece of leather or other flexible material shaped according to the outline shown in FIG. 11 and having a roughly triangular opening 88 cut therein. The sides of opening 88 frame a piece of apertured needlepoint foundation canvas 90 which is attached to scissors case 86 by a line of stitching 92. A cover flap 94, corresponding to the flap 32 of FIG. 1 and the flap 62 of FIG. 8, and formed of flexible material is hingedly attached at its upper edge to scissors case 86 by a line of stitching 96. Scissors case 86 is shaped to form a triangular receptacle having two side panels 87 and 89 when folded along fold line 98 in FIG. 11.

A side extension 100 (FIG. 11) carrying spaced snaps 102 is formed on one side edge of side panel 89 and spaced snaps 104 are attached to the opposite side of panel 87 to coact with snaps 102 to hold the sides of the case 86 together. Snaps 106 and 108 are attached at the bottom end of sides 87 and 89 to secure the bottom.

To work the needlepoint pattern in foundation canvas 90, case 86 is opened and flattened as shown in FIG. 11 and flap 94 is swung up to gain manual access to the rear of foundation fabric 90. After the needlepoint pattern has been completed, flap 94 is lowered to cover the "wrong" side 110 of the needlepoint pattern and the case is folded along line 98 and snaps 102-108 are closed to form the triangular receptacle shown in FIGS. 9 and 10. Snaps 102-108 also hold flap 94 down over the rough inner surface 110 of the needle-point pattern. A top tab 112 carrying a snap 114 extends from the top edge of side panel 87 and is positioned to interact with a snap 116 (FIG. 11) on the opposite edge of side panel 89. Snaps 114 and 116 are opened to admit the scissors into the receptacle and are closed to hold them in.

In all forms of the invention the method of procedure comprises the steps of cutting an opening through a panel of a receptacle, covering the opening with needlepoint canvas, swingably attaching a flexible cover flap of a size to cover the canvas to the inner side of the panel along one edge of the flap, holding the flap in a position swung away from the canvas to expose the inner side of the latter for working, then, while thus holding the flap, working a needlepoint pattern through the canvas with its decorative side facing outwardly and with its wrong side facing inwardly, and releasably fastening the flap in a down position covering the "wrong" side of the needlepoint pattern.

Various changes and modifications may be made without departing from the spirit of the invention, and all of such changes are contemplated as may come within the scope of the claims.

What I claim is:

1. In a receptacle including at least one panel of flexible material having an opening therein which is framed by the material of the panel and said panel having an outer side and an inner side, and having an apertured needlepoint foundation canvas overlapping said panel opening and connected to the framing portions of the panel, the outer surface of said foundation canvas being exposed to view and its inner surface being manually accessible, a needlepoint pattern on said canvas having a decorative side exposed on the outer side of the panel and having a wrong side facing inwardly, the improvement comprising a cover flap hingedly attached along one edge to an opening-framing portion on the inner side of said panel and dimensioned to cover the wrong side of said needlepoint pattern, and means including releasable fasteners on said receptacle for releasably holding said cover flap in a position covering the wrong side of said needlepoint pattern.

2. A receptacle as defined in claim 1 wherein said releasable fastener means comprises cooperable fastener means attached to said cover flap and to a framing portion of said panel.

3. A receptacle as defined in claim 1 wherein said panel is of laminated construction and includes an outer ply and an inner ply with matching openings, and there being means for joining said plies together with edges of said canvas sandwiched therebetween, said cover flap being the material cut out from the opening of said inner ply and being integrally joined to the inner ply along one edge and fitting the opening when closed.

4. A receptacle as defined in claim 3 and further comrpising a tab attached to one edge of said cover flap, and wherein said releasable fasteneres comprise at least one snap fastener on said tab and a matching snap fastener on a framing portion of said inner ply.

5. A receptacle as defined in claim 1 wherein said receptacle includes another panel foldably connected to said first panel and adapted to be normally maintained in back-to-back relationship with the first-mentioned panel with said cover flap therebetween, and including first and second tabs on opposite ends of one of said panels, and wherein said means for releasably holding said cover flap comprises snap fasteners on said tabs and matching snap fasteners on the ends of the opposing panel under said tabs.

6. A receptacle as defined in claim 5 wherein said cover flap is hingedly attached to the upper edge of the first-mentioned panel by a line of stitching and is free on its other edges.

7. A receptacle as defined in claim 1 wherein said receptacle includes a second panel which is integrally foldably joined to the first-mentioned panel along one edge, both of said panels being triangular in shape, a triangular opening having a portion in one panel on one side of the receptacle and a continuing portion in the other panel on the other side of the receptacle, said foundation canvas covering the opening in both panels, an extension on one side edge of one panel folded over the edge of the other panel, and wherein said means for releasably holding said cover flap comprises snap fasteners on said side extension and matching snap fasteners on the overlapped edge of the other side panel.

8. A receptacle as defined in claim 7 wherein said cover flap is hingedly attached to a top framing portion of both side panels by a line of stitching.

* * * * *